United States Patent [19]

Bar-Nefy et al.

[11] Patent Number: 4,552,053

[45] Date of Patent: Nov. 12, 1985

[54] MINEFIELD CLEARING APPARATUS

[75] Inventors: Simcha Bar-Nefy, Omer; Michael V. Tiomkin, Beer-Sheva, both of Israel

[73] Assignee: Israel Aircraft Industries, Ltd., Lod, Israel

[21] Appl. No.: 496,164

[22] Filed: May 19, 1983

[30] Foreign Application Priority Data

May 19, 1982 [IL] Israel ..... 65824

[51] Int. Cl.[4] ..... F41H 11/12

[52] U.S. Cl. ..... 89/1.13; 89/36.08; 171/141; 172/832

[58] Field of Search ..... 89/1 M, 36 H; 172/738, 172/832; 171/141

[56] References Cited

U.S. PATENT DOCUMENTS

| | | | |
|---|---|---|---|
| 1,423,887 | 7/1922 | Stewart | 414/443 X |
| 2,160,972 | 6/1939 | Litchy | 37/275 |
| 2,322,115 | 6/1943 | Cox | 172/766 X |
| 2,388,015 | 10/1945 | Shoemaker | 414/443 |
| 2,425,357 | 8/1947 | Walker | 89/1 M |
| 2,460,322 | 2/1949 | Walker | 89/1 M |
| 2,486,372 | 10/1949 | Rockwell | 172/777 |
| 2,489,349 | 11/1949 | White | 89/1 M |
| 2,933,838 | 4/1960 | Rockwell | 172/832 X |
| 3,238,647 | 3/1966 | Hall | 172/816 |
| 3,513,916 | 5/1970 | Hyler | 172/832 X |
| 3,771,413 | 11/1973 | Sieg | 89/1 M |
| 4,384,620 | 5/1983 | Uchida et al. | 172/815 |

FOREIGN PATENT DOCUMENTS

| | | | |
|---|---|---|---|
| 82303792.4 | 3/1982 | European Pat. Off. . | |
| 914285 | 6/1946 | France . | |
| 682611 | 8/1979 | U.S.S.R. | 172/832 |

OTHER PUBLICATIONS

Jane's Combat Support Equipment, 1st Ed., 1978–1979, Ed. C. F. Foss Macdonald & Jane's Pubs. Ltd., London 1978, p. 178.

Minenraum-Anbaugerat KMT-5 Soldat Und Technik, 4/1976, pp. 176–178.

*Primary Examiner*—David H. Brown

*Attorney, Agent, or Firm*—Cushman, Darby & Cushman

[57] ABSTRACT

Mine clearing equipment mountable on a vehicle. Two plow sections arranged one above the other in hinged engagement are included in apparatus which mounts on a frame and by which mines are raised and shunted aside. The frame in turn is mountable onto the vehicle in raised or lowered orientation. In the frame raised position, the plow sections are in folded engagement. The raising and shunting aside apparatus is angularly oriented with a forward edge adjacent the vehicle interior and a rearward edge adjacent the vehicle side edge. A chain is attached to the forward edges and plow sections in tension when the plow sections are lowered into their operating orientations to define mine barriers.

4 Claims, 6 Drawing Figures

MINEFIELD CLEARING APPARATUS

FIELD OF THE INVENTION

The present invention relates to apparatus for clearing mines, and more particularly to mine clearing apparatus mountable on an armoured vehicle such as a tank.

BACKGROUND OF THE INVENTION

There is described and claimed in applicant's co-pending Israel patent application 63437, which formed the priority basis for our U.S. application Ser. No. 383,214 filed May 28, 1982, now U.S. Pat. No. 4,467,694 apparatus for clearing mines which overcomes the difficulties and disadvantages of conventional prior art mine clearing techniques and apparatus and which comprises a frame mountable onto a vehicle for selectable positioning in a raised or lowered orientation, apparatus for raising and shunting aside mines mounted onto the frame; and apparatus for selectably retaining the frame in a raised orientation and comprising control apparatus operable from inside the vehicle for releasing the frame from the raised orientation and allowing it to assume the lowered orientation.

There is also described and claimed in applicant's co-pending Israel patent application 64023, which formed the priority basis for our U.S. application Ser. No. 383,213 filed May 28, 1982, now U.S. Pat. No. 4,491,053, apparatus for clearing mines comprising a frame mountable onto a vehicle for selectable positioning in a raised or lowered orientation, plow apparatus for raising and shunting aside mines mounted onto the frame and apparatus for automatically raising the plow from its lowered orientation to its raised orientation in response to backwards motion of the vehicle and including mounting apparatus rotatably mounted onto the vehicle, spring supporting apparatus mounted onto the mounting apparatus and attached to the plow apparatus; and tooth apparatus fixed onto the mounting apparatus and arranged for selectable engagement with the vehicle tread, the spring supporting apparatus being operative when the plow is in its lowered orientation to urge the tooth apparatus into driven engagement with the vehicle tread whereby during backwards movement of the vehicle the mounting apparatus rotates in a first direction, thereby extending the length of the spring supporting apparatus, and increasing the spring force thereof until a spring force is reached at a first position of the mounting apparatus sufficient to raise the plow to its raised orientation. Continued rotation of the mounting apparatus raises the plow until it engages a retaining hook, and is held stationary.

SUMMARY OF THE INVENTION

The present invention seeks to provide various improvements to the apparatus for clearing mines described in the aforementioned co-pending Israel patent applications.

There is thus provided in accordance with one preferred embodiment of the invention mine clearing apparatus for attachment to a vehicle and comprising a frame mountable onto a vehicle for selectable positioning in a raised or lowered orientation; apparatus mounted onto the frame for raising and shunting aside mines including first and second plow sections disposed one above another in hinged engagement, the second plow section being associated with a plurality of plow teeth which, in operation, extend below the ground surface, the first and second plow sections being operative to lie in generally the same plane during operation and in folded engagement when the frame is in its raised orientation, the raising and shunting aside apparatus being mounted on the frame in front of the ground engaging members on each side of the vehicle and being angularly oriented to have a forward edge adjacent the interior of the vehicle and a rearward edge adjacent the side edge of the vehicle, each of the forward edges being provided with a chain attached to the first and second plow sections such as to be tensioned when the first and second plow sections are in their operating orientations to thereby define a barrier against mines passing from adjacent the forward edge to the relatively unprotected area at the interior of the vehicle.

Further in accordance with an embodiment of the present invention, there is provided apparatus for clearing mines comprising a frame mountable onto a vehicle for selectable positioning in a raised or lowered orientation, apparatus mounted onto the frame for raising and shunting aside mines and apparatus for selectably retaining the frame in a raised orientation and including control apparatus operable from inside the vehicle for selectably releasing the frame from its raised orientation and allowing it to assume its lowered orientation, the selectably retaining apparatus including a hook member pivotably mounted onto the vehicle at a central location on the hook member and having a roller engaging slot at a first end thereof, an intermediate link pivotably coupled to the hook member at a second end thereof opposite to the first end with respect to the central location, an operating lever of elongate configuration, pivotably mounted at a first end thereof onto the vehicle and pivotably attached to the intermediate link at a first intermediate location along the operating lever, a pull cable attached to the operating lever at a second end thereof and a spring connection between a second intermediate location and a fixed location with respect to the vehicle, the selectably retaining apparatus being operative to move from a roller retaining orientation to a pin releasing orientation as the first intermediate location crosses the line connecting the pivot mounting of the first end of the operating lever and the pivot mounting at the second end of the hook member.

Additionally in accordance with an embodiment of the present invention there is provided apparatus for clearing mines comprising a frame mountable onto a vehicle for selectable positioning in a raised or lowered orientation; apparatus mounted onto the frame for raising and shunting aside mines; and a gliding surface supporting the frame in its lowered orientation, the gliding surface being disposed rearwardly of the apparatus for raising and shunting aside mines.

Further in accordance with an embodiment of the present invention, hydraulic positioning means are provided for governing the orientation of the gliding surface relative to the frame. The hydraulic positioning means may be operative in response to the outputs of an orientation sensor mounted onto the vehicle.

BRIEF DESCRIPTION OF THE DRAWINGS

The present invention will be more fully understood and appreciated from the following detailed description taken with reference to the drawings in which.

DETAILED DESCRIPTION OF THE INVENTION

Figure 1:
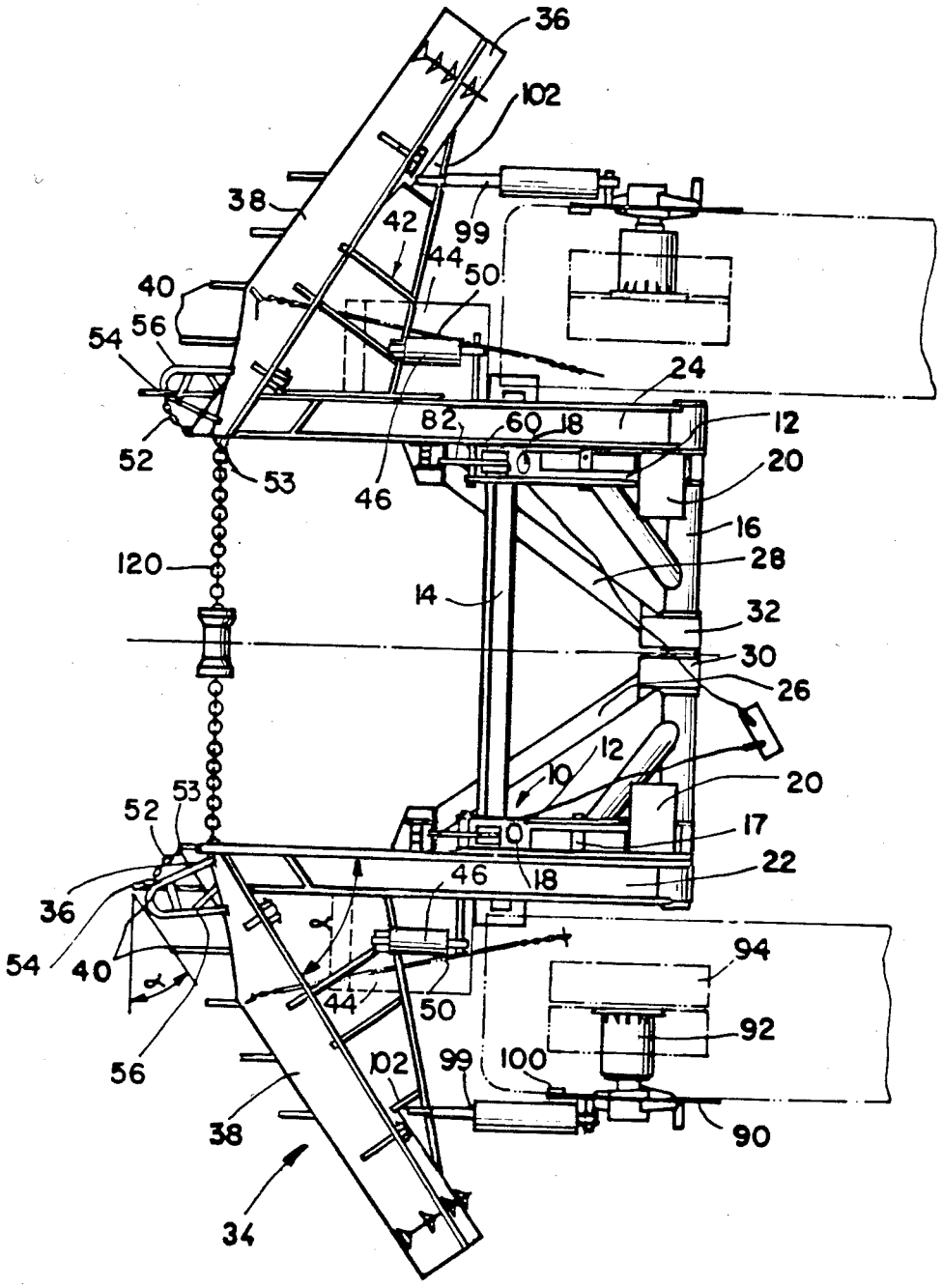
FIG. 1 is a top view illustration of mine clearing apparatus constructed and operative in accordance with an embodiment of the present invention.

Reference is now made to FIGS. 1-5B which illustrate mine clearing apparatus constructed and operative in accordance with an embodiment of the present invention. The present description is presented with particular reference to mine clearing apparatus which is mountable onto a particular type of tank, the M-60 Patton. It is appreciated that this is entirely for the purpose of illustration and that the inventionis applicable to other types of tanks and possibly other vehicles as well.

As seen in the illustrations, the mine clearing apparatus comprises a frame 10 including a pair of identical side portions 12 which are joined at their front end by a cross bar 14 and at their rear end support an axle 16. Frame 10 is rigidly mounted onto an armoured vehicle such as a M-60 tank in the illustrated embodiment by engagement of pins 17 located at side portons 12 with towline lugs fixed onto the tank. Rigidity of mounting is provided by bolts 18 which engage the underside of the tank and force mounting plates 20, fixedly mounted onto side portions 12 on the opposite side of pins 17, into tight engagement with the underside hull of the tank.

First and second arms 22 and 24 are independently rotatably mounted onto axle 16 and extended forwardly thereof in generally parallel planes. Arms 22 and 24 are strengthened by reinforcing elements 26 and 28 respectively which are fixed at one end thereof to the respective arms and are rotatably mounted by means of clamps 30 and 32 onto axle 16.

Rigidly mounted onto each of arms 22 and 24 is a mine plowing assembly 34. Mine plowing assembly 34 comprises main plow portion 36, of generally elongate configuration and concave cross section.

The general configuration of main plow portion 36 may be similar to that of an ordinary vehicle powered snow plow. Disposed above main plow portion 36 and hinged thereonto is an auxiliary plow portion 38. Auxiliary plow portion 38 has two positions, a lowered position in which it extends forwardly of the surface of main plow portion 36 and a raised position in which it defines an upper continuation of the surface of the main plow portion 36. This hinged construction is to obviate the problem of interference with a drivers field of vision or with the range of operation of the armament on a tank. Towards this end, the hinged auxiliary plow portion 38 may be lowered when the plowing assembly 34 is in its raised orientation.

Disposed below main plow portion 36 there are provided a plurality of vertically disposed planar blades 40, which during operation are disposed below the ground surface. The horizontal spacing betwen adjacent vertical blades is selected to be such that anti-vehicle mines will of necessity be engaged thereby. The blades are provided with an inclined forward surface, so as to raise mines located under the ground surface into engagement with main plow portion 36, so that they may be plowed aside.

A desired depth of operation of blades 40 is determined by means of a gliding surface assembly 42 which is articulatedly mounted onto each of arms 22 and 24 and onto corresponding plow portions 36. The gliding surface assembly 42 comprises a sled 44 which is pivotably mounted onto plow portion 36 and is arranged to slide on the ground surface rearwardly of the plow and of blades 40. A piton and cylinder combination 46 which is mounted onto each respective arm and sled 44 determines the orientation of the sled relative to the respective arm so as to maintain the blades 40 at a predetermined operating depth. The operation of piston and cylinder combination 46 is controlled in such a way that the blades 40 do not tend to dig deeper and deeper into the ground surface. One way of accomplishing this end is to provide a ground surface sensor 48 (FIG. 4) associated with microswitches 49 which respond to the presence and or absence of contact between the sensor 48 and the ground surface and provie a control function through suitable conventional logic control circuitry to the piston and cylinder combination 46, which preferably is hydraulically operated. Other types of sensors may also be employed.

The orientation of the gliding surface assembly 42 rearwardly of the plow rather than alongside the plow is believed to obviate a potential problem encountered in the embodiments described in the aforesaid Israel patent applications 64023 and 63437 wherein a mine might tend to be exploded by the gliding surface assembly.

It is a particular feature of the present invention that the arrangement of the gliding surface assembly is such that the reaction forces generated by ground engagement of the blades 40 and the remainder of the plowing apparatus are transferred to sled 44 and thus to the ground surface rather than to the vehicle.

A chain 50 extends from each auxiliary plow portion 38 to a location on the tank hull or onto frame 10. The length of the chain 50 is selected such that it is slack when the plowing assembly is in its raised orientation but becomes tight when the plowing assembly is lowered, thus pulling on auxiliary plow portion 38 and orienting it towards a generally vertical orientation. The full raised orientation of the auxiliary plow portion 38 is reached only when soil being plowed is forced thereagainst.

Figure 3:
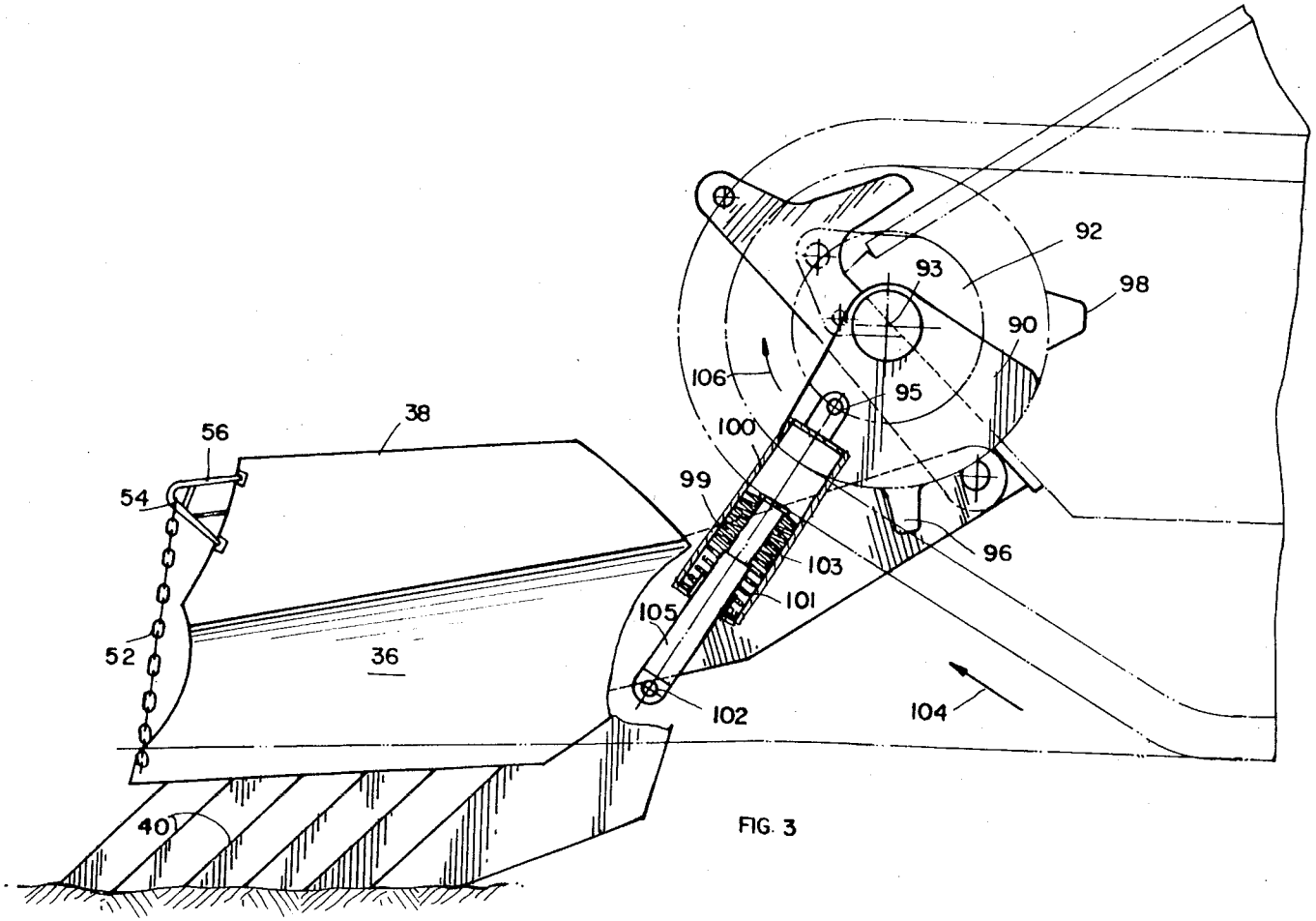
FIG. 3 is a side view illustration of the apparatus of FIG. 1 in a lowered orientation.

An additional chain 52 is disposed at the inner facing edge 53 of each plowing assembly and extends from the lower inner corner of each plow portion 36 to a location 54 defined by the extreme forward facing portion of a bracket 56 disposed on auxiliary plow portion 38. When the plowing assembly is in a raised orientation and plow portions 36 and 38 are in relative folded orientation, the chain is slack and does not interfere with folding of the plow portions or with operations of the vehicle. When the plowing assembly is in its lowered operating orientation as seen in FIG. 3, chain 52 is taut and defines a barrier which prevents mines excavated by the plowing assembly from rolling or being directed inwardly of the inner facing edge of the plowing assembly into the region which is unprotected by a plowing assembly.

Figure 4:
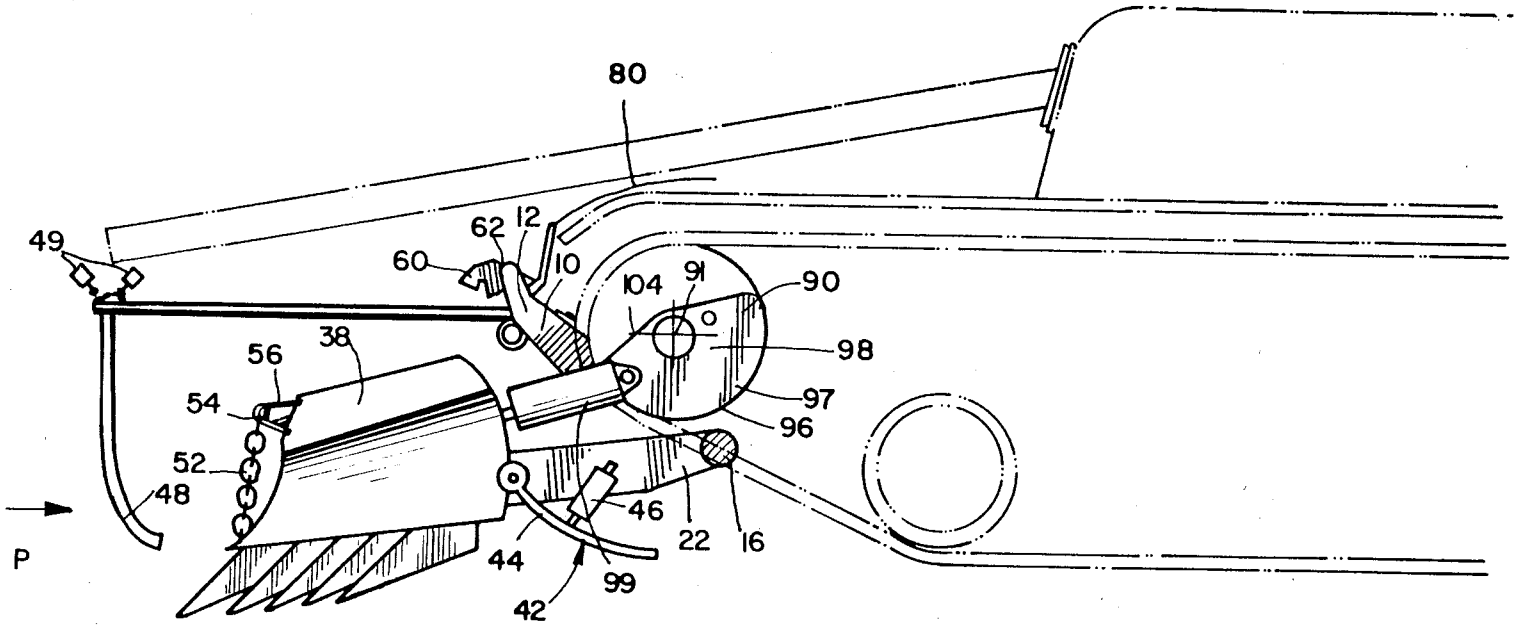
FIG. 4 is a sie view illustration of the apparatus of FIGS. 1-3 in a lowered operating orientation, with the addition of ground level sensing apparatus.
Figure 5A:
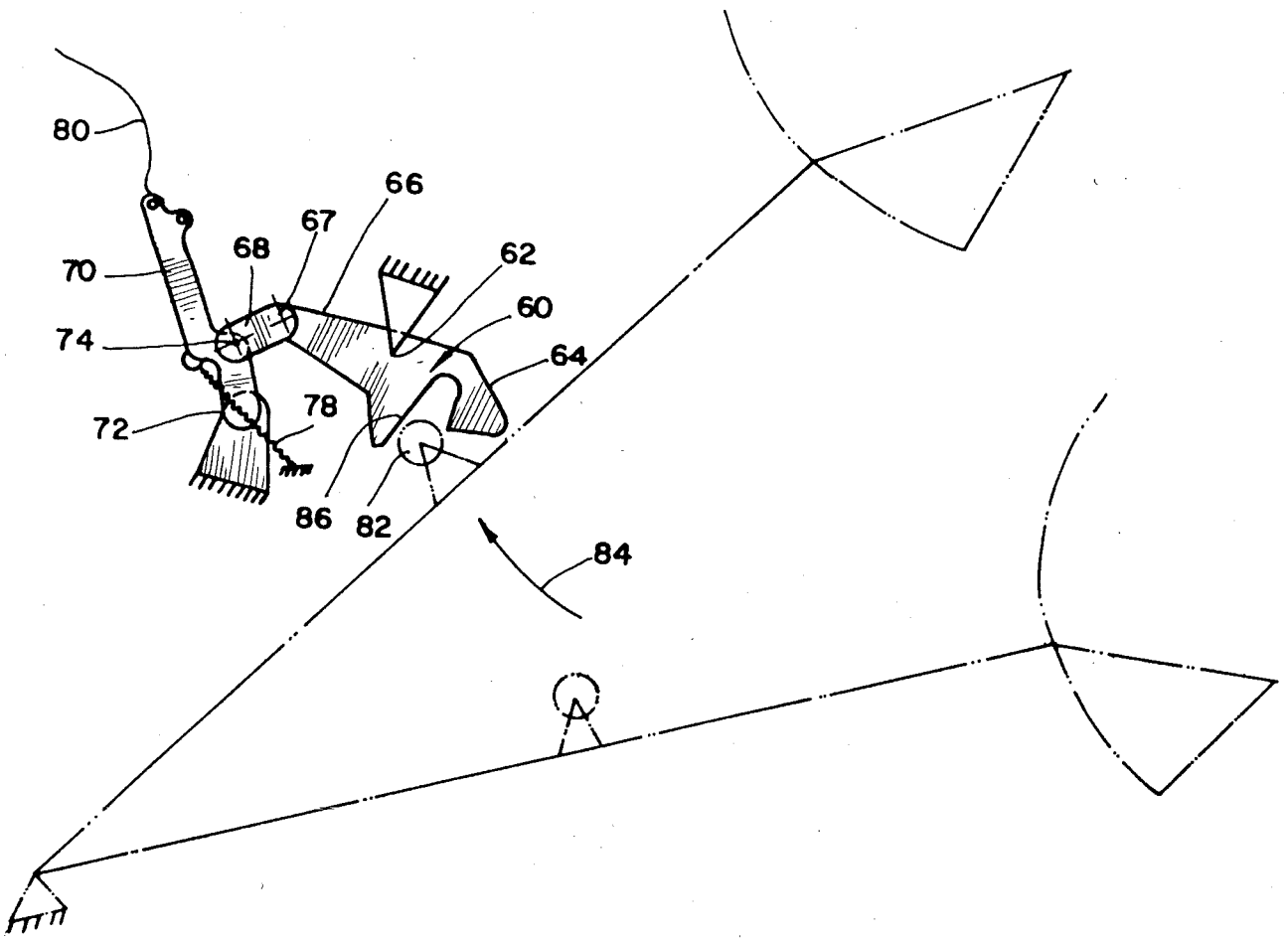
FIGS. 5A and 5B are respective views of a locking mechanism forming part of the apparatus of FIGS. 1-3 in respective locked and unlocked orientations.
Figure 5B:
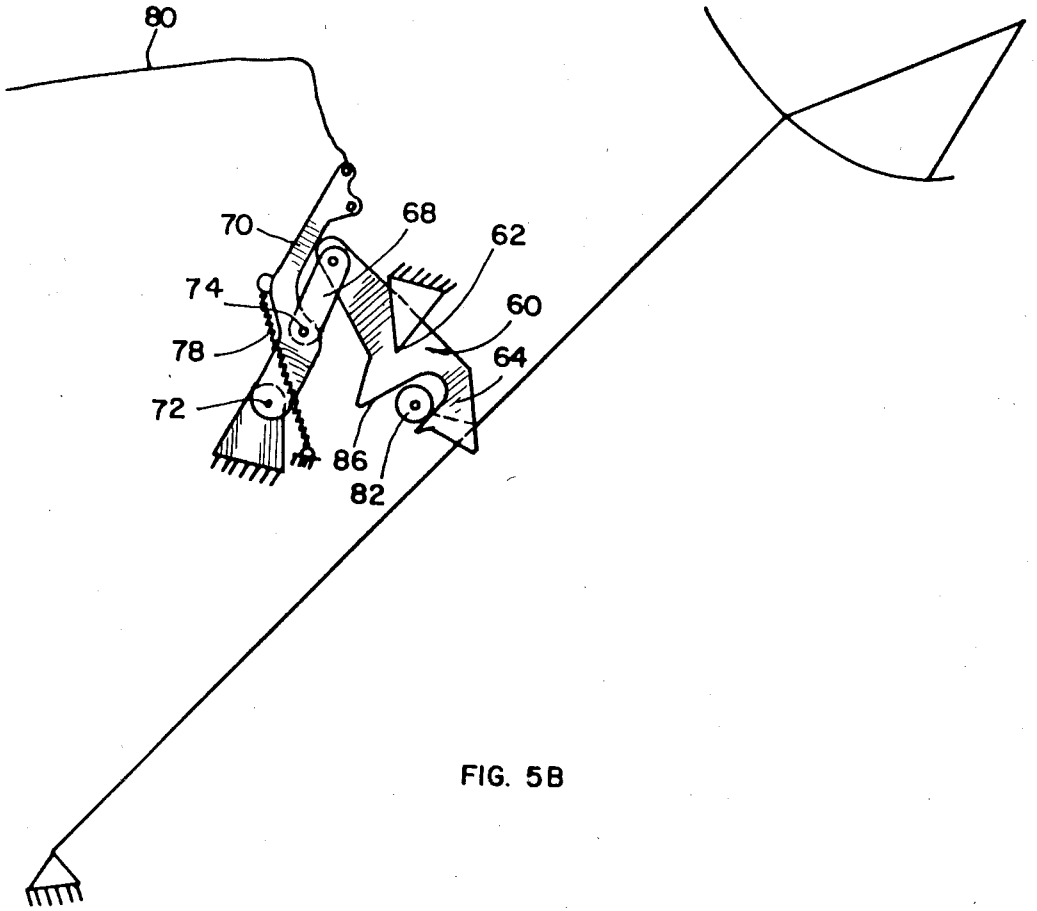

Reference is now made additionally to FIGS. 5A and 5B, which together with FIGS. 1-4 illustrate apparatus for retaining the arms in their raised orientation and for selectable release thereof. A hook member 60, is pivotably mounted about an axis 62 onto each side portion 12 and comprises a socket portion 64 located at one end thereof and a lever portion 66 at another end thereof and having pivotably mounted thereon at a pivot location 67, an intermediate member 68. A selectable release lever 70 is pivotably mounted onto each side portion 12 about an axis 72 and is pivotably mounted onto intermediate member 68 at a pivot location 74. A spring 78 joins release lever 70 to a fixed location on each side portion 12. The spring tends to urge the lever 70 to remain in whichever position it is in. A cable connection 80 is provided to the interior of the vehicle, such that pulling on the cable is operative to provide counter-clockwise movement of lever 70 about its pivot axis 72 (as seen in FIGS. 5A and 5B). It is noted that spring 78 is in an over-center type of arrangement which provides its indicated dual function. It is appreciated that the cable connection may be replaced by any other suitable displacement means, such as a solenoid operated device, actuated from inside the vehicle, for displacing lever 70 as desired.

The operation of the apparatus described hereinabove will be understood from a consideration of FIGS. 5A and 5B. FIG. 5A shows a retainer roller 82 which is fixedly mounted onto each of arms 22 and 24 about to engage socket portion 64 and moving in an arc illustrated by an arrow 84. Engagement of roller 82 with a surface 86 of the socket portion forces the hook member to pivot in a clockwise direction about its pivot axis 62 (in the sense of FIGS. 5A and 5B).

The clockwise movement of the hook member 60 causes lever portion 66 to rotate, also in a clockwise sense, and to raise intermediate member 68 causing reorientation of the intermediate member 68 and thus of lever 70 such that pivot location 74 crosses the imaginary line joining pivot locations 67 and 72. This over-center orientation is illustrated in FIG. 5B and provides a stable locking orientation of the retaining apparatus. Hook member 60 is thus prevented from counterclockwise rotation into an open orientation. Roller 82 is thus securely engaged by hook member 60 and arms 22 and 24 are maintained in their respective raised orientation, provided that lever 70 remains in the locked position (FIG. 5B).

When it is desired to lower arms 22 and 24 to their respective lowered, ground engaging orientations, it is sufficient to pull on respective cables 80 from the safety of the driver's compartment. Pulling of cables 80 causes the lever 70 to pivot in a counterclockwise direction and to draw pivot location 74 back across the imaginary line joining pivot locations 67 and 72. Once the pivot location 74 crosses this line, counterclockwise motion of hook member 60 is permitted in response to the force exerted by the weight of the plowing apparatus applied to roller 82. It is a particular feature of the illustrated construction that only a very small amount of travel of lever 70 is required for releaseof the plowing apparatus into its lowered orientation.

Hook member 60 is then free to rotate in a counterclockwise direction about its pivot such that roller pin 82 is released, thus allowing arm 22 or 24 as the case may be and the associated mine plowing assembly 34 to fall by gravity into their respective lowered orientations in engagement with the ground.

Reference is now made once again to FIGS. 1–4 which also illustrate apparatus for automatically lifting the mine plowing assembly. There are provided two installations of such apparatus, corresponding to the two mine plowing assemblies. The apparatus for automatically lifting the mine plowing apparatus comprises a freely rotatable disk segment 90 which is bearing mounted onto a mounting member 92 which is bolted onto a tension wheel 94 of a tank. Tension wheel 94 engages the tread of a tank and maintains it at a desired tension. Mounted on an outer facing surface of disk segment 90 at a first radius from the pivot locating 93 about which the disk segment rotates, is a mounting pin 95. Mounted on an edge surface of disk segment 90 are first and second spaced teeth 96 and 98 which selectably engage the interstices defined between plates of the tank tread in accordance with an embodiment of the invention.

Spring supporting apparatus 99 comprises a spring housing 100 which is rotatably mounted at a first end thereof onto mounting pin 95 and a spring compressing rod 105 which is connected at an exterior end thereof to a location 102 fixed onto the main plow portion 36. Spring supporting apparatus 99 may be generally described as comprising a spring loaded extensible support member formed of elements 100 and 105 and comprising first and second springs 101 and 103 arranged in a series arrangement. Springs 101 and 103 preferably have greatly different spring forces. Typically, spring 101 is an ordinary heavy duty coil spring while spring 103 comprises a series of independent disk or belleville springs which are characterized in that they undergo complete compression at a compressive force of about 7 ton. It is appreciated that any other suitable spring arrangement may be employed alternatively and that the arrangement of apparatus 99 is such that extension of apparatus 99 produces compression of springs 101 and 103.

Figure 2:
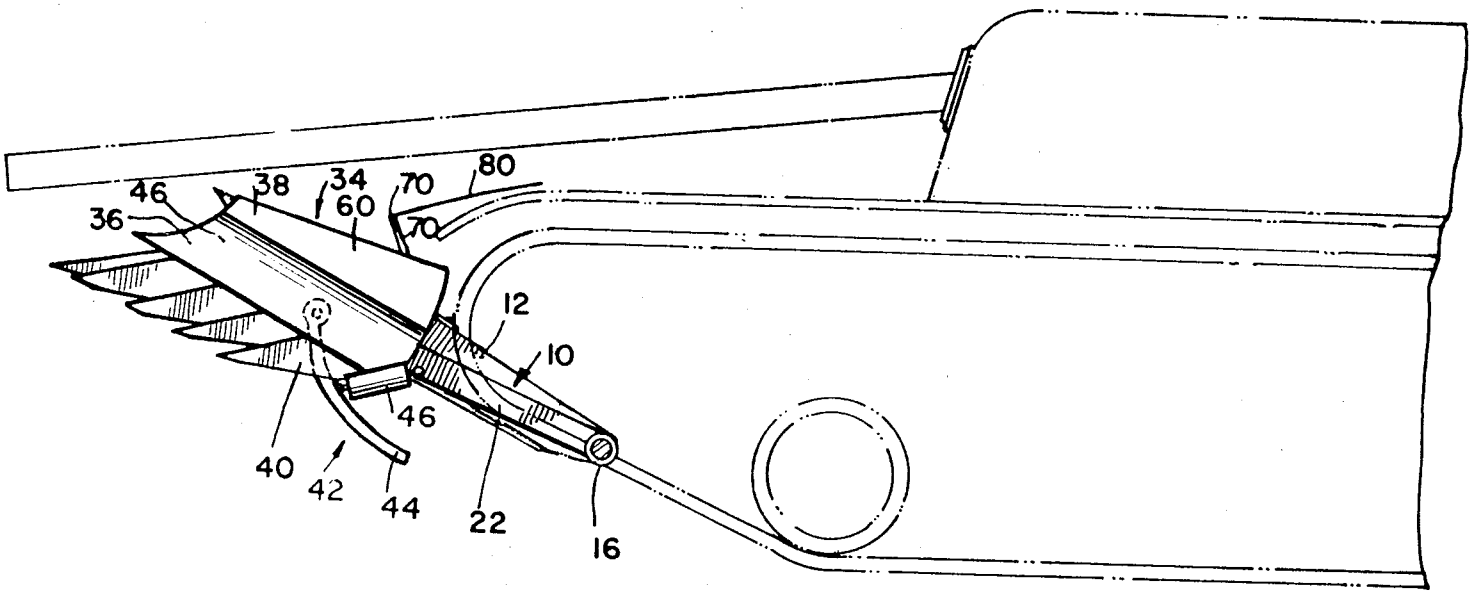
FIG. 2 is a side view illustration of the apparatus of FIG. 1 in a raised orientation.

The operation of spring supporting apparatus 99 and of the entire apparatus for automatically lifting the mine plowing assembly will now be described with reference to FIGS. 2–4.

In order to understand the operation of the automatic lifting apparatus, it is necessary to appreciate the details of construction of disk segment 90 and the relative positions of teeth 96 and 98 and pin 95 thereon. As seen in the drawings, the direction of motion of the tank treads during reverse motion of the tank is indicated by an arrow 104. Upon engagement of at least one of teeth 98 with the tank treads, the disk segment 90 is caused to rotate in a clockwise direction, indicated by an arrow 106 about pivot location 93. With respect to this direction of rotation, indicated by arrow 106, pin 95 leads tooth 96 by about 20° and tooth 96 leads tooth 98 by about 90°.

FIG. 3 shows the plowing assembly in a fully lowered plowing orientation prior to engagement of tooth 96 with the tank treads. In this orientation, spring 101 is compressed to about one-half of its maximum length. This is the orientation during forward mine clearing operation of the tank.

When it is desired to raise the mine clearing apparatus to a raised orientation, the tank simply shifts to reverse motion. Due to the position of tooth 96 which is pressed against the tank tread during motion in a forward direction as illustrated in FIG. 3, reverse motion of the tank tread in a direction indicated by arrow 104, tends to draw tooth 96 into driven engagement therewith, causing clockwise rotation of disk segment 90 in a direction indicated by arrow 107. An initial backwards movement of the tank causes the blades 40 to lie on the ground surface instead of being buried partially therebelow.

Continued backward motion of the tank and consequent clockwise rotation of disk segment 90 causes the length of supporting apparatus 99 to increase until spring 101 is fully compressed. As the fully raised orientation roller 82 engages hook member 60 in locked engagement for retaining the arm and associated plowing assembly in the raised orientation and preventing further upward movement thereof.

With continued backwards movement of the tank treads, the disk segment 90 continues to rotate due to the engagement of tooth 98 with the treads, even after tooth 96 becomes disengaged therefrom. This continued rotation combined with the immobility of the plowing assembly due to its raised locked orientation causes spring 103 to become compressed. Maximum compression occurs at an orientation wherein the longitudinal axis of spring supporting apparatus 99 intersects the axis of rotation of disk segment 90 at pivot location 93. Further rotation of the disk segment 90 in response to further movement of the tank tread in a backwards direction is operative to permit disengagement of tooth 98 for the tread. The spring force of springs 101 and 103 is then operative to snap the disk segement 90 in further clockwise motion to a final orientation, wherein the spring force of the spring supporting apparatus 99 is at a minimum and the teeth 96 and 98 are fully disengaged from the tank tread. Rod 105 defines the minimum length of apparatus 99.

The click of the decompression of the springs 101 and 103 provides a noise sensible to the driver of the tank, indicating to him that he can commence forward motion of the tank with the plowing assembly in a raised orientation.

A limit chain is provided for attachment between frame 10 and each of arms 22 and 24 to prevent arms 22 and 24 from falling beyond a certain limit in the event that a sudden drop in the groud level is encountered, as such a drop could otherwise bring the plowing assembly into engagement with the tank treads.

It is noted that the plowing assembly engages the ground surface in the vicinity of the treads and outwardly thereof. In order to protect the intermediate portion of the tank from mine damage, a weighted chain 120 is mounted between the two plowing assemblies to engage and detonate any mines that are encountered at a safe distance from the tank.

It will be appreciated by persons skilled in the art that the invention is not limited to what has been particularly shown and described hereinabove. Rather the scope of the invention is defined only by the claims which follow:

We claim:

1. Apparatus for clearing mines comprising:

a frame mountable onto a tank for selectable positioning in a raised or lowered orientation;

apparatus mounted onto said frame for raising and shunting aside mines including a plow portion and a plurality of vertically disposed blades which during operation are disposed below the ground surface and are operative to raise mines buried in the ground, said blades having the tendency to dig deeper and deeper into the ground surface unless restrained;

a gliding surface supporting said frame in its lowered orientation, for operation of said plow portion and disposition of said blades below the ground surface, said gliding surface being disposed rearwardly of said plow portion and plurality of blades;

hydraulic positioning means for governing the orientation of said gliding surface relative to said frame; and a ground surface sensor mounted on said tank and providing control instructions to said hydraulic positioning means for maintaining the blades at a predetermined operating depth relative to the ground surface.

2. Apparatus for clearing mines according to claim 1 and also comprising apparatus for selectable retaining said frame in a raised orientation and including control apparatus operable from inside said vehicle for selectably releasing said frame from its raised orientation and allowing it to assume its lowered orientation;

said selectably retaining apparatus including:

a hook member pivotably mounted onto said vehicle at a central location on said hook member and having a roller engaging slot at a first end thereof;

an intermediate link pivotally coupled to said hook member at a second end thereof opposite to said first end with respect ot said central location;

an operating lever of elongate configuration, pivotably mounted at a first end thereof onto said vehicle and pivotably attached to said intermediate link at a first intermediate location along the loperating lever;

displacement means attached to said operating lever at a second end thereof; and a spring connection between a second intermediate location and a fixed location with respect to said vehicle;

said selectably retaining apparatus being operative to move from a roller retaining orientation to a roller releasing orientation as said first intermediate location crosses the line connecting the pivot mounting of said first end of the operating lever and the pivot mounting at said second end of said hook member.

3. Mine clearing apparatus according to claim 1 and wherein:

said plow portion includes first and second plow sections disposed one above another in hinged engagement;

said first and second plow sections being operative to lie in generally the same plane during operation and in folded engagement when said frame is in its raised orientation;

said raising and shunting aside apparatus being mounted on said frame in front of the ground engaging members on each side of the tank and being angularly oriented to have a forward edge adjacent the interior of the tank and a rearward edge adjacent the side edge of the tank; and each of said forward edges being provided with a chain attached to said first and second plow sections such as to be tensioned when said first and second plow sections are in their operating orientations to thereby define a barrier against mines passing from adjacent said forward edge to the relatively unprotected area at the interior of said vehicle.

4. Apparatus for clearing mines according to claim 3 and also comprising apparatus for selectable retaining said frame in a raised orientation and including control apparatus operable from inside said vehicle for selectably releasing said frame from its raised orientation and allowing it to assume its lowered orientation;

said selectably retaining apparatus including:

a hook member pivotably mounted onto said vehicle at a central location on said hook member and having a roller engaging slot at a first end thereof;

an intermediate link pivotably coupled to said hook member at a second end thereof opposite to said first end with respect to said central location;

an operable lever of elongate configuration, pivotably mounted at a first end thereof onto said vehicle and pivotably attached to said intermediate link at a first intermediate location along the loperating lever;

displacement means attached to said operating lever at a second end thereof; and a spring connection between a second intermediate location and a fixed location with respect to said vehicle;

said selectably retaining apparatus being operative to move from a roller retaining orientation to a roller releasing orientation as said first intermediate location crosses the line connecting the pivot mounting of said first end of the operating lever and the pivot mounting at said second end of said hook member.

* * * * *